US007207565B1

(12) United States Patent
Masty, III

(10) Patent No.: US 7,207,565 B1
(45) Date of Patent: Apr. 24, 2007

(54) BOUNCING BALL BOARD GAME

(76) Inventor: Andrew J. Masty, III, 1339 28th St., Manistee, MI (US) 49660

( * ) Notice: Subject to any disclaimer, the term of this patent is extended or adjusted under 35 U.S.C. 154(b) by 0 days.

(21) Appl. No.: 11/160,843

(22) Filed: Jul. 12, 2005

(51) Int. Cl.
*A63B 67/00* (2006.01)

(52) U.S. Cl. ..... 273/342; 273/381

(58) Field of Classification Search ..... 273/342; 235/1 B, 60.16, 123
See application file for complete search history.

(56) References Cited

U.S. PATENT DOCUMENTS

| | | | | | |
|---|---|---|---|---|---|
| 453,310 | A | | 6/1891 | Reed | |
| 642,903 | A | | 2/1900 | Hachmuth | |
| 689,054 | A | | 12/1901 | Bauer | |
| 713,704 | A | * | 11/1902 | Smith | 273/348.5 |
| 742,416 | A | | 10/1903 | Hall | |
| 823,507 | A | | 6/1906 | Carr | |
| 1,315,927 | A | * | 9/1919 | Geib | 273/123 R |
| 1,616,270 | A | | 2/1927 | Madden | |
| 2,126,873 | A | | 8/1938 | Czajkowski | |
| 2,301,265 | A | | 11/1942 | Fandrey | |
| 3,822,063 | A | | 7/1974 | Rea | |
| 3,913,918 | A | * | 10/1975 | Trachtman | 273/126 R |
| 3,968,967 | A | * | 7/1976 | Nally | 473/423 |
| 4,354,685 | A | * | 10/1982 | Hampson | 273/342 |
| 4,497,486 | A | * | 2/1985 | Bennett | 273/144 B |
| 4,573,689 | A | | 3/1986 | Sultzbaugh | |
| 4,726,592 | A | | 2/1988 | Callaham | |
| 4,768,781 | A | * | 9/1988 | McMillin | 473/16 |
| 4,863,175 | A | | 9/1989 | Ricks, Jr. et al. | |
| 5,351,968 | A | | 10/1994 | Starnes | |
| 5,566,948 | A | | 10/1996 | Kidd | |
| 5,622,369 | A | * | 4/1997 | Rogers | 273/398 |
| 6,010,414 | A | * | 1/2000 | Snow | 473/422 |
| 6,843,478 | B1 | * | 1/2005 | Hoepelman | 273/342 |
| 2004/0188942 | A1 | * | 9/2004 | Trokan | 273/342 |

OTHER PUBLICATIONS

KB-Toys, Bulls-Eye Ball Electronic Talking Target Game, on-line catalog, 2002, four pages (two from KB-Toys ad, two from another website for picture), PlacesinTown.com, U.S.

AREYOUGAME.COM, Tiddly Winks Game, on-line catalog, 2005 (referring to 1888 publication date for original game), one page, www.areyougame.com, U.S.

* cited by examiner

*Primary Examiner*—Mark S. Graham
(74) *Attorney, Agent, or Firm*—Northern Michigan Patent Law, PLC

(57) ABSTRACT

A game in which a ball is thrown or bounced onto a horizontal game board from an adjacent bouncing surface such as a table, most of a target portion of the game board surface being covered with raised ball-deflecting projections in a grid pattern, the remainder of the target portion consisting of ball-retaining depressions defined by the projections and approximating the size of the ball. The ball is preferably a ping-pong type ball that reacts with the game board in a manner making it extremely difficult to place the ball in a particular scoring depression on the first bounce.

19 Claims, 4 Drawing Sheets

BOUNCING BALL BOARD GAME

FIELD OF THE INVENTION

The present invention is in the field of board games in which one or more balls or projectiles is bounced or thrown onto and retained by a horizontal game board.

BACKGROUND AND DESCRIPTION OF RELATED ART

Games in which a projectile such as a ball or some other projectile is thrown or bounced onto a game board are well-known.

One class of such games provides a cup or basket into which projectiles such as small balls and bottle caps are bounced or thrown, for example as shown in U.S. Pat. No. 1,616,270 to Madden; U.S. Pat. No. 2,126,873 to Czajkowski; U.S. Pat. No. 2,301,265 to Fandrey; U.S. Pat. No. 3,822,063 to Rea; U.S. Pat. No. 4,726,592 to Callaham; U.S. Pat. No. 4,863,175 to Ricks, Jr. et al.; and U.S. Pat. No. 5,351,968 to Starnes.

Another class of such games uses a game board with a plurality of holes or recesses designed to retain a ball or other projectile, or to let the projectile pass through the board, the holes generally having different scores associated with them. See, for example, U.S. Pat. No. 453,310 to Reed; U.S. Pat. No. 642,903 to Hachmuth; U.S. Pat. No. 742,416 to Hall; and U.S. Pat. No. 823,507 to Carr.

Yet another class of such games provides a game board with one or more cups or holes or projectile-retaining regions, and projectile-deflecting portions such as raised bumps or stakes or pyramids to increase the variety or difficulty or unpredictability of the projectile's travel over the board toward or between target areas. Examples of such games include U.S. Pat. No. 689,054 to Bauer; U.S. Pat. No. 4,573,689 to Sultzbaugh; and U.S. Pat. No. 5,566,948 to Kidd. These game boards generally have raised edges or borders to retain the projectiles on the board, in the case of Bauer the game board sitting inside a box and having a preferred transparent cover with a center hole through which the projectile is dropped onto a central deflector on the game board.

Prior bounce-onto-the-game board games tend to have only a single form of play, and/or they are relatively easy to master and thus do not interest the players for very long.

BRIEF SUMMARY OF THE INVENTION

The present invention is a game having a horizontal game board and one or more balls capable of being thrown or bounced from an adjacent surface onto the game board. The game board comprises a target surface in which a major portion of the board's target surface is covered with raised ball-deflecting projections, and a minor portion of the board's target surface comprises relatively small interstitial ball-retaining hollows or depressions between the ball-deflecting projections. The ball-retaining depressions are defined by the ball-deflecting projections, and are approximately equal to the diameter of the ball, such that when the ball is "seated" in a depression it engages at least some (and preferably all) of the surrounding deflecting surfaces of the projections. This gives the ball the pronounced tendency on the first bounce or two to be more easily deflected by the projections than to be retained in the depressions, requiring a delicate and skilled touch that keeps the game challenging even after being played many times. In the most preferred form, the relative sizing and spacing of the deflecting portions and depressions and the resiliency of the ball make the game board so reactive that it is difficult to make a ball stay in the first depression in which it lands.

The ball-retaining depressions are preferably arranged in a regular grid pattern, and a further feature of the invention is a visible, multi-directional scoring grid associated with the depressions and each of the game board sides from which players can bounce a ball onto the grid, such that players playing from different sides of the board are presented with identical scoring opportunities without having to change places during their respective turns.

A further feature of the invention is a board sidewall that simultaneously forms a barrier over which the ball must be bounced to reach the game board, an aid for keeping the ball on the game board, and a support for raised scoring racks. In a preferred form, the game board and sidewall form a lower portion of a game storage box.

Another feature of the invention is a backboard that can be mated generally vertically with the horizontal game board to form a backstop for a variation of the game. In a preferred form the backboard is provided with a target zone of its own that the ball must hit on its way to the horizontal game board. In a most preferred form the backboard is part of a game box cover.

Yet another feature of the invention is a noise-generating device responsive to a ball striking first the adjacent bouncing surface, and then the game board, amplifying the sound associated with the ball's bounce and adding to the game's appeal.

Another feature of the invention is the use of counter type scoring racks associated with each player's side of the board, the scoring racks visible to the other players from their playing positions, each rack using a subset of visually distinguished beads or counters spaced to spell out a word or count, thereby giving a rough but quick visual indication of score to the other players during the heat of the game.

The game board lends itself to a variety of playing modes and games, including but not limited to tic-tac-toe type ball placement games; simple scoring games; turn-taking and simultaneous ball-bouncing modes; and single and multiple player games. The invention includes two basic game methods using the board: scoring and pattern placement.

These and other features and advantages of the invention will be apparent from the following description of the accompanying drawings.

DETAILED DESCRIPTION OF THE INVENTION

Figure 1:
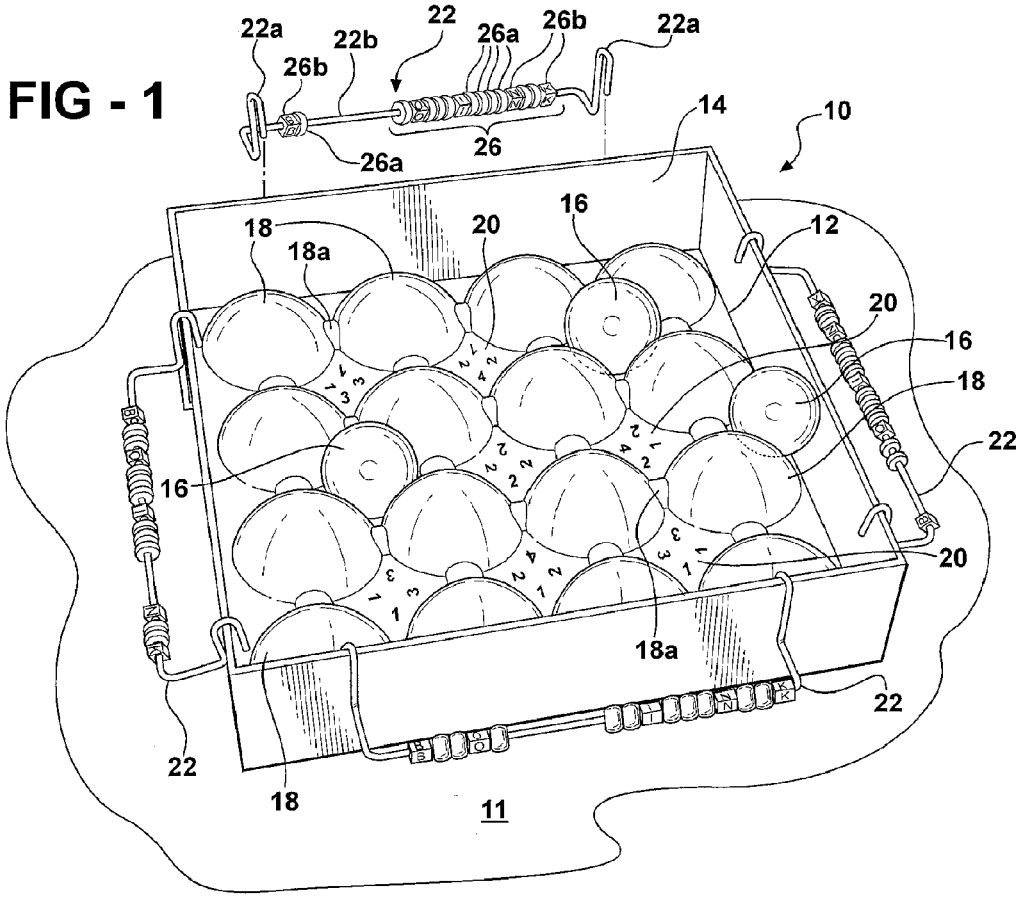
FIG. 1 is a perspective view of a preferred example of a game board according to the invention.
Figure 2:
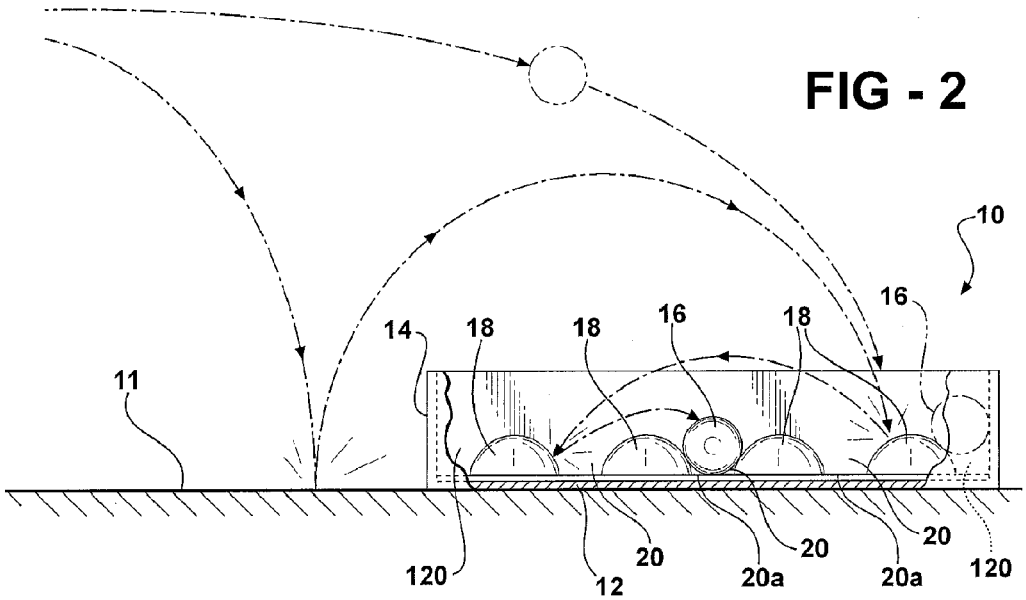
FIG. 2 is a side elevation view of the game board of FIG. 1, showing two modes of landing a ball on the board, and a board sidewall cut away to show the action of the ball on the board.

Referring first to FIGS. 1 and 2, the invention is illustrated in a preferred example of a game board 10 having a target tray 12 and a sidewall 14. Board 10 is designed to rest essentially flat on a substantially horizontal surface 11 (such as a table or floor) that is suitably hard and even for bouncing balls 16 from surface 11 onto tray 12. It is also possible to provide the board with an attached or detachable bouncing pad (not shown) designed to be positioned next to board 10 to enable play on softer or uneven surfaces. While the game board 10 should be horizontal during play, and typically the adjacent bouncing surface will be horizontal as well, it is possible to bounce balls 16 from non-horizontal surfaces near the game board. Balls 16 are preferably light and bounce easily, ping-pong type balls being the preferred example. Symmetrical round balls are highly preferred, but it is also possible to use irregularly-shaped "balls". And while bouncing a ball onto the board from an adjacent surface is the preferred method of projecting a ball onto the board, and is accordingly the focus of the illustrated examples, the ball could also be projected through the air onto the game board by throwing or mechanically launching directly onto the board as shown in phantom in FIG. 2.

Tray 12 includes a peripheral wall 14 to provide an initial hurdle over which the balls must be bounced, and to help contain balls 16. The major portion of the tray's surface inside wall 14 is taken up with raised deflecting portions 18, in the preferred, illustrated embodiment in the form of hemispherical domes having a height less than the height of wall 14. It will be understood that raised deflectors 18 could take other shapes, for example with non-circular or faceted surfaces, but rounded, hemispherical deflectors are highly preferred for the reactive interface they create with round balls. Individual deflectors 18 do not provide a surface on which balls 16 can rest, and have a surface shape and resiliency relative to balls 16 to cause balls 16 to be deflected to other parts of the tray, or even off the tray over retaining wall 14 if the ball's velocity is sufficient. In the illustrated example, tray 12 is formed by a known molding process from a relatively rigid, thin-walled plastic, and may contain residual molding channels such as 18*a* running between domes 18. In the illustrated example, tray 12 is formed from an inverted billiard ball storage rack, and domes 18 are hollow. It will be understood that the tray 12 could be formed from other materials or processes and could be made by joining multiple pieces, and that deflectors 18 could be solid or hollow.

A minority of the surface of tray 12 between deflectors 18 consists of hollows or depressions 20 whose size and shape are defined by the adjacent surfaces of deflectors 18. In the illustrated embodiment using hemispherical dome-shaped deflectors, depressions 20 are (when viewed from above the board) generally diamond-shaped with concave curved sides. Depressions 20 include flats or bottoms 20*a*, with a resiliency relative to balls 16 similar to (or greater than) that of deflectors 18. The ball-bouncing characteristics for flats 20*a* can be achieved by placing the material of the flats in contact with the table or other hard supporting surface 11 (preferred), or by spacing the flats from surface 11 and using an appropriate plastic material and thickness. While flat bottoms 20*a* are preferred, it would be possible to provide bottoms 20*a* with non-flat surfaces, for example with deflector projections of their own smaller than deflectors 18. And while flat bottoms 20*a* that contact balls 16 at rest are preferred, it would also be possible to space deflectors 18 such that a ball 16 would be supported entirely on the surfaces of deflectors 18 surrounding a depression 20 when the ball came to rest.

Another preferred feature of game board 10 is its being essentially entirely composed of the raised deflectors 18 and the ball-retaining depressions 20 defined between them, as illustrated. This makes the entire surface of the board reactive, resulting in more exciting play.

Figure 6:
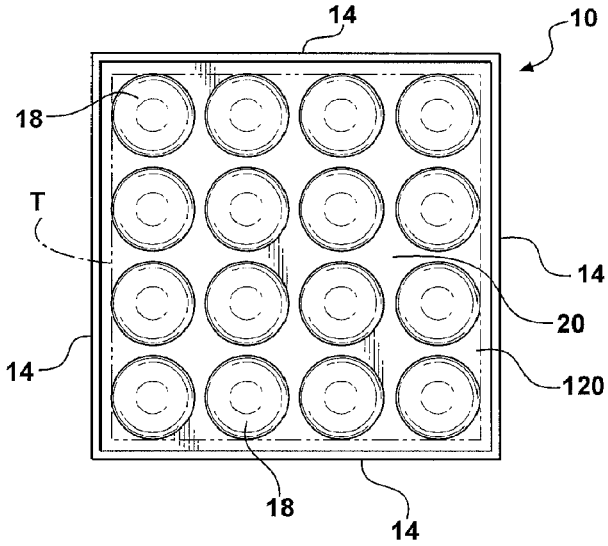
FIGS. 6 and 6A–6B are top plan views of alternate game board shapes for the board of FIG. 1.

In the illustrated example, the area between the outermost deflectors 18 and the higher sidewall 14 is a marginal area of ball-trapping partial depressions 120 in which the ball has a greater tendency to come to rest than to bounce back into the depressions 20 of the target or scoring area T (FIG. 6) on tray 12. To achieve this, the perpendicular sidewall 14 is spaced from the deflectors less than the diameter of a ball 16, preventing the ball from landing on a reactive flat between the wall and deflectors, the vertical wall tending to absorb more of the ball's energy (and therefore further reduce its velocity) than would a deflector 18, tending to trap the ball between sidewall 14 and the outermost deflectors 18 in one of depressions 120 as shown in FIGS. 1 and 2.

In the preferred, illustrated example, deflectors 18 and depressions 20 are sized and shaped such that a ball 16 at rest in a depression 20 makes point contact with at least some, and preferably all, of the surrounding deflectors 18, as well contacting bottom surface 20*a* as best shown in FIG. 2. It has been found with these deflector/depression proportions that the ball will tend to be deflected out of a particular depression until it loses sufficient kinetic energy after one or more bounces. This is believed to result from the unlikelihood of a ball 16 evenly striking all four of the surrounding deflectors 18 at once. And even if ball 16 were to land sufficiently centered to strike a flat 20*a* simultaneously with one or more of the surrounding deflectors, the reactive nature of the ball relative to the flat makes it more likely to bounce out of the depression 20 than to stay, for at least the first bounce or two.

By way of example, the illustrated target area T of tray 12 comprising deflectors 18 and depressions 20 (best shown in FIG. 6) defined between them is approximately 64.0 square inches, with the domed deflectors being approximately 1.0 inches high and 2.0 inches in diameter, the distance between diagonally opposite deflectors being approximately 1.0 inches, and the balls 16 being approximately 1.5 inches in diameter. These are currently preferred dimensions and proportions, but it should be understood that the proportions could be varied to alter the degree of reactivity between balls 16 and tray 12, and the dimensions could be varied for bigger or smaller or differently shaped game boards. Also, although target area T in the illustrated example has been defined at the outermost edges of deflectors 18 because the ball has at least a possibility of bouncing back into a scoring depression 20 on tray 12 after being deflected into sidewall 14, it can be defined differently depending on the likelihood of a ball bouncing back into one of the scoring depressions from the outer edges of the deflector array. The less likely to bounce back in, the more likely that the target area T can be considered to lie inwardly, for example at the center of each peripheral deflector 18 on tray 12.

It will be understood that while the above characteristics are achieved with light, hollow, relatively rigid ping-pong type balls 16 and a rigid molded plastic tray 12, the properties and materials of the tray and the balls could be altered relative to one another to produce similar results, and depending on whether the ball is intended to be bounced or thrown onto the board.

In the most preferred form, retaining wall 14 is formed by the lower half 30*a* of a game box 30, in which tray 12 is removably stored. Wall 14 could also consist of removable panel portions detachably secured at or near the edges of tray 12, or sidewall 14 and/or lower box half 30*a* could be integrally formed with tray 12, for example during a molding process.

FIG. 1 also shows a preferred form of scoring racks 22, detachably secured to the edges of sidewall 14 and visible from each side of board 10 so that each player can see across the board for a quick view of the other players' scores. In the illustrated embodiment, racks 22 are formed from metal or plastic rod or wire, with hooks 22*a* adapted to fit over the sidewall 14 and a horizontal bead track 22*b* spaced from wall 14. A plurality of beads or similar slidable counters 26 is carried on each track 22*b*, capable of being slid from one side to another in abacus-like fashion to count up scores. In the preferred form of the illustrated embodiment, subsets of plain beads 26*a* are divided by extra-visible beads 26*b*, for example of a different color and/or shape and/or size, extra-visible beads 26*b* further preferably having special indicia such as letters or numbers to give the other players a quick view of the player's progress. In the most preferred form, the extra-visible beads 26*b* spell out the name of the game (such as "Boink!"), and when all of them have been moved from one side of the rack to the other the word is fully spelled and the player can shout out that the game is over.

FIG. 1 shows board 10 and balls 16 in a first embodiment of a game method according to the invention, in which each of up to four players (one player per side of the illustrated square board) has bounced a ball 16 onto the board. This first game is a simple scoring game, with each of depressions 20 having a score associated with it, for example with scoring indicia 21 such as numbers. Each player takes a turn bouncing his or her ball off adjacent table surface 111 over sidewall 14 onto target tray 12, hopefully coming to rest in one of the scoring depressions 20 in area T rather than in non-scoring area marginal depressions 120 or bouncing off board 10 completely. After each round, the players add their scores up on scoring racks 22 with counters 26, the first player reaching a certain score (for example, fifteen points) as evidenced by the counters winning the game. Possible variations of this game are numerous, and include different methods of determining who goes first; having all players simultaneously bounce their balls 16 onto board 10; continuous play (i.e., no discrete turns or rounds) until the first person tallies up the winning number of points with repeated bounces; loss of accumulated points each time a ball goes off the board or lands in a non-scoring depression 120; requiring a player to shout out a word indicating a win before another player; requiring the winning sum of points to be reached with an exact score (if a player has twelve points and fifteen is a win, the player must land his ball in a depression 20 worth three points).

For scoring games, depressions 20 have different scores associated with them, requiring players to place their balls 16 in particular depressions for a particular number of points. In the preferred form illustrated in FIGS. 1–3, the scoring indicia 21 associated with each depression 20 are directional, such that players playing from different sides of the board are presented with similar or identical scoring grids. For example, a player playing from side 14*a* will be presented with scoring options "1", "2", and "3" in what to him is the left hand column of depressions 20, ascending in a direction away from side 14*a*. The player opposite at side 14*b* is presented with an oppositely oriented set of numbers in those same depressions (in what to him is the right-hand column). In similar fashion, the middle column relative to side 14*a* presents ascending options "1", "2", and "4", while the right-hand column relative to side 14*a* is again "1", "2", "3". All four players see the same grid from their respective sides 14*a*, 14*b*, 14*c*, and 14*d*.

Figure 3:
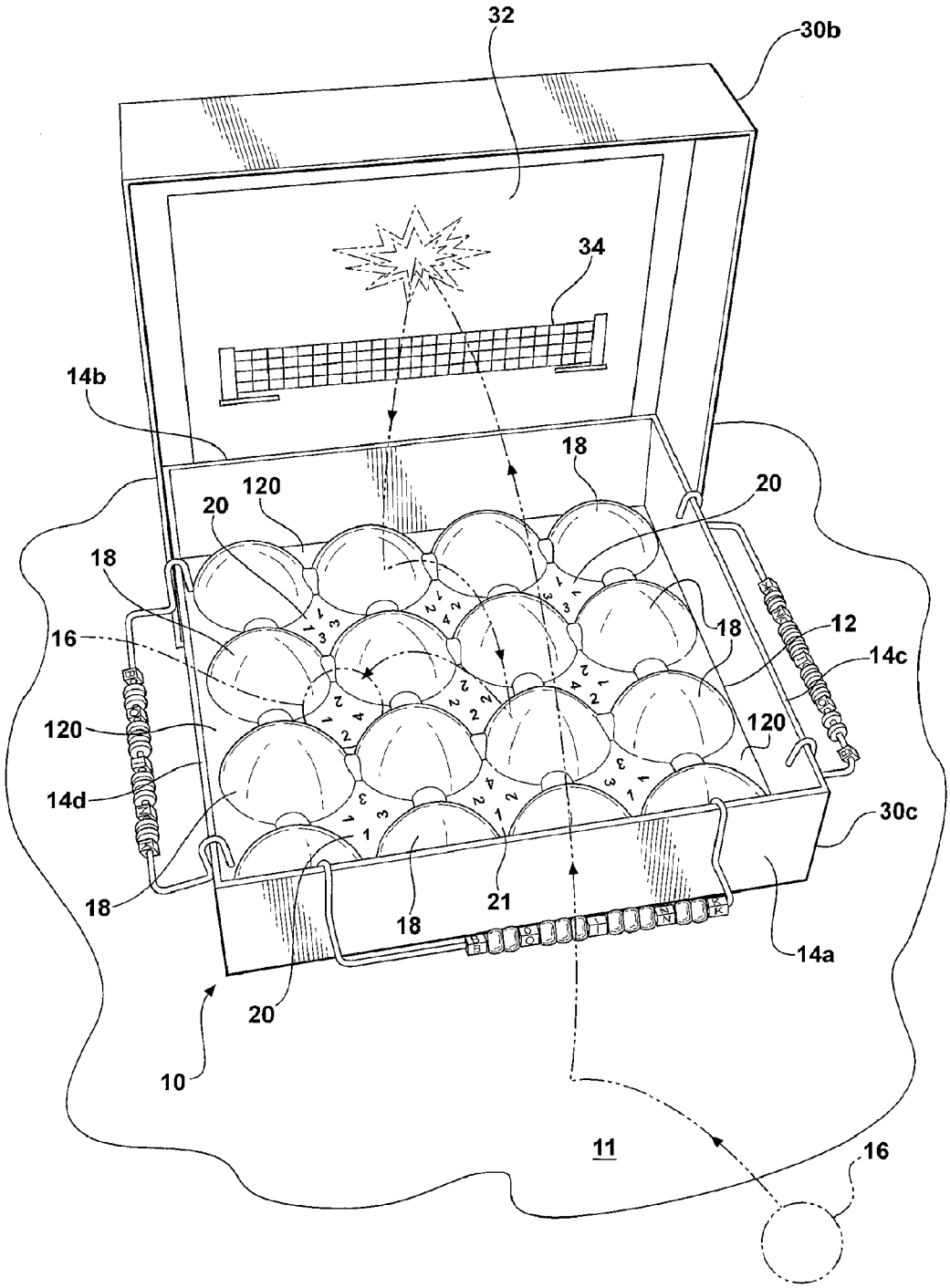
FIG. 3 is similar to FIG. 1, but shows a box cover integrated with the horizontal game board to form a backboard for a bounced ball.

Referring next to FIG. 3, a game box cover 30*b* that normally fits over lower box portion 30*a* for sale or storage is designed to mate with one side or end of horizontal game board 10 to form a generally vertical backboard surface 32. The opposite side of board 10 (in FIG. 3, side 14*a*) becomes the only playing side from which a ball is bounced. Ball 16 is bounced from table 11 over tray 12 to first strike backboard 32, hopefully in a manner causing it to rebound onto tray 12 where it behaves similarly to the balls in FIG. 1. In the most preferred form of this embodiment, backboard 32 is provided with a boundary or line 34, for example a line drawing of a tennis net, above or below which the ball 16 must strike for the bounce to count. In this backboard or rebound version of the game, the method of play will preferably be simple turn-taking until a player reaches the winning score. Other variations in play such as those described above for FIG. 1 will be apparent to those skilled in the art, including the possibility of throwing rather than bouncing the ball into backboard 32.

Figure 4:
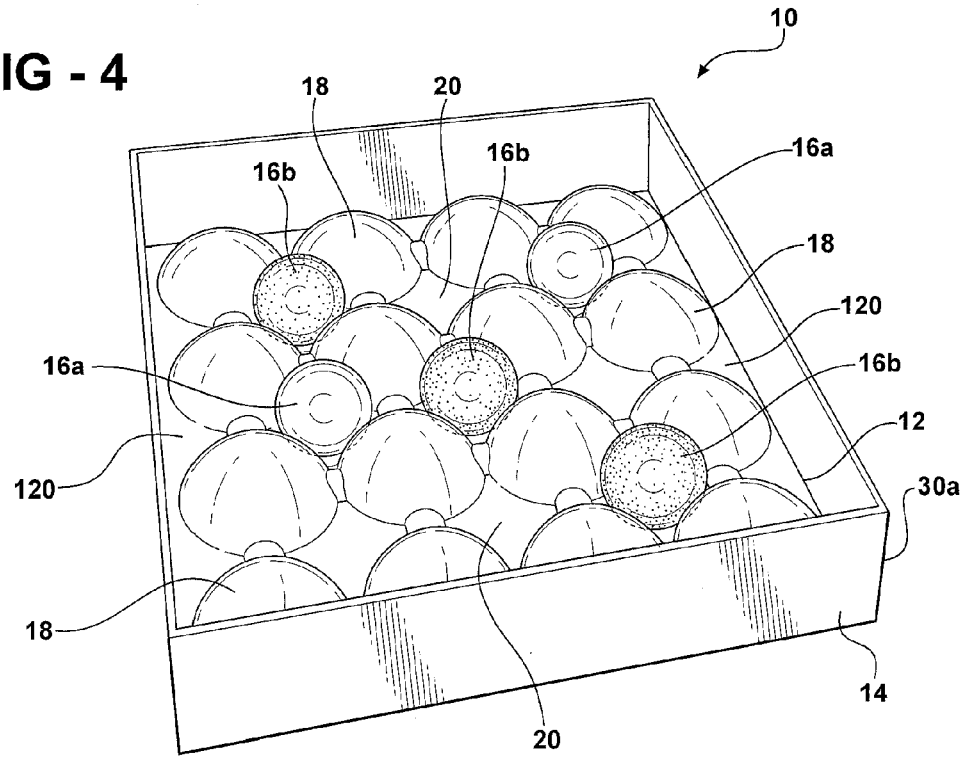
FIG. 4 is similar to FIG. 1, with balls shown in position on the board for a tic-tac-toe type placement game.

FIG. 4 shows the game board 10 of FIG. 1 being used for a second basic game method, namely a ball placement game such as tic-tac-toe, in which players successively bounce their balls 16*a* and 16*b* in order to fill depressions 20 in a particular pattern. Other ball-placement game possibilities include but are not limited to checkers type games, or filling a majority or a highest number of depressions 20.

Figure 5:
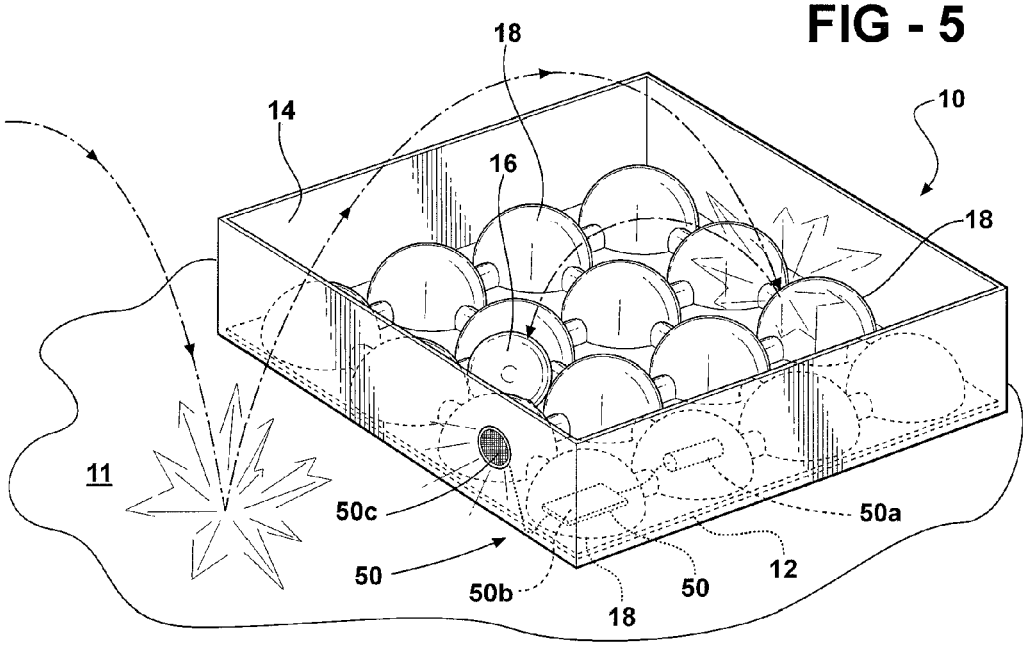
FIG. 5 shows the game board of FIG. 1 modified with an internal sound-generating mechanism responsive to a ball's bounce on both the board and on the adjacent bouncing surface.

FIG. 5 illustrates an optional noise-generating modification to game board 10, in which a device 50 of a type known for use in children's toys comprising a battery 50*a*, a battery-powered noise chip or circuit board with an included or connected ball-bouncing sensor (such as a vibration-responsive mercury switch) 50*b*, and a speaker 50*c* hidden under tray 12, for example on a flat table-contacting bottom side of the box, or in one or more of deflectors 18, vibrationally coupled to the both the bouncing surface 11 and target tray 12 to produce an entertaining noise each time a ball 16 is bounced on surface 11 adjacent game board 10, and each time the ball subsequently contacts any portion of target tray 12. It will be understood by those skilled in the art that different known noise-generating devices could be used, including but not limited to vibration-responsive devices and noise-responsive devices triggered by the distinctive sound of the bouncing ball 16 on hard surfaces such as table 11 and tray 12. It will also be understood that the sound produced by device 50 could be programmed to vary in response to the ball 16 striking different surfaces, or to vary as the ball loses kinetic energy between bounces, or to vary in other ways. In the preferred form, the sound made by device 50 is a "bouncing" sound similar to that of a bouncing ball.

Figure 6A:
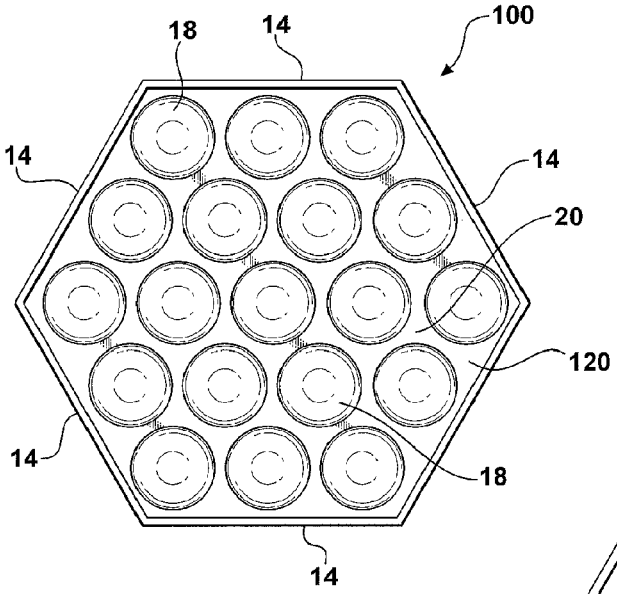
Figure 6B:
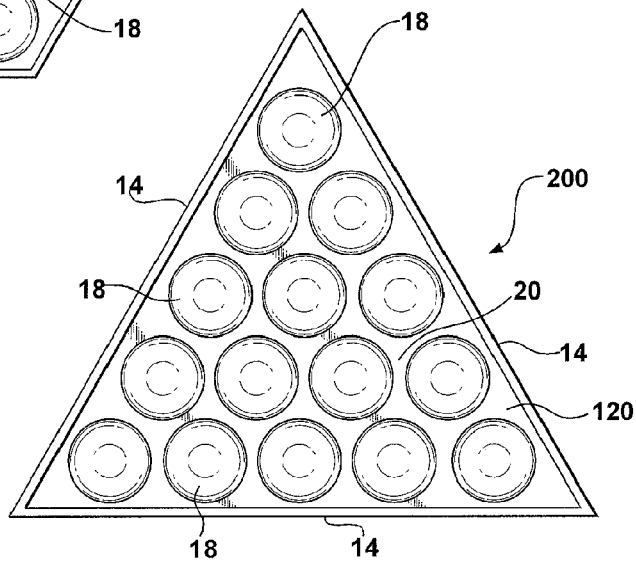

FIGS. 6A and 6B illustrate two of many possible different shapes for game board 10, including a hexagonal board 100 and a triangular board 200. Other than their shapes, boards 100 and 200 are of similar construction and are used like board 10 with balls 16.

It will finally be understood that the disclosed embodiments are representative of presently preferred forms of the invention, but are intended to be illustrative rather than definitive of the invention. The scope of the invention is defined by the following claims. I accordingly claim:

What is claimed is:

1. A game comprising a horizontal game board and one or more balls capable of being projected through the air onto the game board, the game board comprising a target surface, a major portion of the board's target surface comprising raised ball-deflecting projections, and a minor portion of the board's target surface comprising smaller interstitial ball-retaining depressions defined between the ball-deflecting projections, the ball-retaining depressions comprising ball-bouncing flats, wherein the ball-retaining depressions have a width or diameter approximately equal to the diameter of the ball, such that when the ball is seated at rest in a depression it engages the depression's ball-bouncing flat and at least some of the surrounding ball-deflecting projections.

2. The game of claim 1, wherein essentially the entire target surface of the game board is composed of the ball-deflecting projections and the ball-retaining depressions.

3. The game of claim 1, wherein the raised ball-deflecting projections are dome-shaped.

4. The game of claim 3, wherein the raised ball-deflecting projections are hemispherical.

5. The game of claim 1, wherein the balls are ping-pong type balls.

6. The game of claim 1, wherein the game board comprises different playing sides from each of which a player can project a ball onto the game board without having to change places with other players.

7. The game of claim 6, wherein the game further includes a scoring rack associated with each playing side, each scoring rack visible from all of the playing sides.

8. The game of claim 7, wherein each scoring rack comprises a plurality of slidable counters movable from one end of the rack to another end of the rack to indicate score accumulation, the counters comprising a first set of counters and a second set of extra-visible counters dividing the first set of counters into subsets.

9. A game comprising a horizontal game board and one or more balls capable of being projected through the air onto the game board, the game board comprising a target surface, a major portion of the board's target surface comprising raised ball-deflecting projections, and a minor portion of the board's target surface comprising smaller interstitial ball-retaining depressions defined between the ball-deflecting projections, wherein the game board comprises different playing sides from each of which a player can project a ball onto the game board without having to change places with other players, wherein the game further includes a scoring rack associated with each playing side, each scoring rack visible from all of the playing sides, wherein each scoring rack comprises a plurality of slidable counters movable from one end of the rack to another end of the rack to indicate score accumulation, the counters comprising a first set of counters and a second set of extra-visible counters dividing the first set of counters into subsets, and wherein the extra-visible counters include indicia which together spell a name of the game.

10. The game of claim 1, wherein the game board includes an open target surface and a surrounding sidewall whose height is greater than a height of the raised ball-deflecting projections.

11. The game of claim 10, wherein the game includes a backboard portion substantially vertically mateable with the horizontal game board, the backboard portion having a height greater than the sidewall.

12. The game of claim 11, wherein the backboard portion comprises a game board cover adapted to be removed from the game board to expose the open target surface for game play.

13. A game comprising a horizontal game board and one or more balls capable of being projected through the air onto the game board, the game board comprising a target surface, a major portion of the board's target surface comprising raised ball-deflecting projections, and a minor portion of the board's target surface comprising smaller interstitial ball-retaining depressions defined between the ball-deflecting projections, wherein the game board includes a noise-generating device responsive to a bounce of the ball on an adjacent bouncing surface before it reaches the game board to generate an entertaining sound.

14. The game of claim 13, wherein the entertaining sound is alliterative of a bouncing ball sound.

15. The game of claim 1, wherein each of the depressions has scoring indicia associated therewith and visible to each of the players.

16. A method for playing the game of claim 1, comprising the following steps: placing the game board on a horizontal support; projecting a ball through the air so that the ball lands on the game board; and, counting a score associated with a ball-retaining depression when the ball comes to rest in that depression.

17. The method of claim 16, wherein the game board comprises different playing sides, and different players project different balls onto the game board from the different playing sides.

18. The method of claim 16, further including a generally vertical backboard associated with the horizontal game board, and wherein the ball is projected onto the backboard so that the ball lands on the game board.

19. A method for playing the game of claim 1, comprising the following steps: placing the game board on a horizontal support; projecting a ball through the air so that the ball lands on the game board; and, projecting one or more additional balls onto the game board in an attempt to place the balls in the ball-retaining depressions in a winning ball placement pattern not dependent on scores associated with individual ball-retaining depressions.

* * * * *